US006491123B1

(12) United States Patent
Pasquini et al.

(10) Patent No.: US 6,491,123 B1
(45) Date of Patent: Dec. 10, 2002

(54) ELECTRIC EARTH-MOVING VEHICLE PARTICULARLY FOR POORLY VENTILATED LOCATIONS

(75) Inventors: Paolo Pasquini, Bologna (IT); Giacomina Venieri, Viale Orsini, 9/1, 48022 Lugo (IT)

(73) Assignees: VF Venieri S.p.A., Lugo (IT); Giacomina Venieri, Lugo (IT)

( * ) Notice: Subject to any disclaimer, the term of this patent is extended or adjusted under 35 U.S.C. 154(b) by 0 days.

(21) Appl. No.: 09/507,732

(22) Filed: Feb. 22, 2000

(30) Foreign Application Priority Data

Feb. 24, 1999 (IT) ..... BO99A0076

(51) Int. Cl.[7] ..... B60R 16/04; B60K 1/02; G05D 1/04; A01B 63/00

(52) U.S. Cl. ..... 180/68.5; 180/65.1; 172/6; 37/348

(58) Field of Search ..... 180/65.1, 68.5; 172/2, 6; 37/348

(56) References Cited

U.S. PATENT DOCUMENTS

| | | | | | |
|---|---|---|---|---|---|
| 3,721,353 | A | * | 3/1973 | Erickson | 180/65.1 |
| 3,821,997 | A | * | 7/1974 | Sieren | 180/65.1 |
| 3,870,935 | A | * | 3/1975 | Abels et al. | 318/52 |
| 3,963,131 | A | * | 6/1976 | Dimmer | 214/40 |
| 4,013,136 | A | * | 3/1977 | Fear | 180/68.5 |
| 4,026,378 | A | * | 5/1977 | DePriester | 180/68.5 |
| 4,074,785 | A | * | 2/1978 | Masevice | 180/68.5 |
| 4,397,365 | A | * | 8/1983 | Harbe et al. | 180/68.5 |
| 4,405,280 | A | * | 9/1983 | Cochran et al. | 414/685 |
| 4,705,449 | A | * | 11/1987 | Christianson et al. | 414/68.5 |
| 4,711,467 | A | | 12/1987 | Link et al. | |
| 4,949,805 | A | * | 8/1990 | Mather et al. | 180/333 |
| 5,004,081 | A | * | 4/1991 | Custer | 180/68.5 |
| 5,562,178 | A | * | 10/1996 | Worden et al. | 180/291 |
| 5,734,238 | A | * | 3/1998 | Yanagisawa et al. | 318/139 |
| 6,065,565 | A | * | 5/2000 | Puszkiewicz et al. | 182/2.9 |
| 6,189,636 | B1 | * | 2/2001 | Kikukawa | 180/68.5 |

FOREIGN PATENT DOCUMENTS

EP 0 962 597 12/1999

* cited by examiner

*Primary Examiner*—Brian L. Johnson
*Assistant Examiner*—Jeff Restifo
(74) *Attorney, Agent, or Firm*—Guido Modiano; Albert Josif; Daniel O'Byrne

(57) ABSTRACT

An electric earth-moving vehicle, particularly for poorly ventilated locations, comprising an electric motor drive for driving wheels of the vehicle, a hydraulic unit which is actuated by a further electric motor drive for equipment installed on the vehicle, at least two sets of batteries for the motor drives, a control unit for connecting the motor drives to the two sets of batteries which is adapted to connect the motor drives individually or simultaneously to one set of batteries or the other or to both, and a supporting chassis which has, in a median and downward region, a tunnel for inserting one of the two sets of batteries.

10 Claims, 7 Drawing Sheets

ELECTRIC EARTH-MOVING VEHICLE PARTICULARLY FOR POORLY VENTILATED LOCATIONS

BACKGROUND OF THE INVENTION

The present invention relates to an electric earth-moving vehicle, particularly for poorly ventilated locations.

Small vehicles are known for earth-moving in confined spaces or for low power levels which preferably have a hydraulic drive which is controlled by a pump which is driven by an internal-combustion engine: in particular, some vehicles can be fitted, at the front or at the rear, with buckets, loading shovels, blades, lifting forks, excavators, mills, drills, rotating brushes or equipment of any kind which will be designated hereinafter generically as equipment and which is usually hydraulically powered.

Vehicles of this kind are extremely effective, but when used in confined spaces, such as mines, basements, ship holds, industrial buildings, historical city centers, cemeteries or the like, they have the drawback that their internal-combustion engines emit exhaust gases and produce noise at levels which are particularly unwanted in such environments.

In practice, there is the need for vehicles which reduce the coefficients of acoustic and chemical aggressiveness and which in giving broad assurances of environment-friendliness have a gentle impact on the user and on the citizens involved.

On the other hand, differently from battery-powered electric-drive vehicles known as fork-lift trucks, which are meant to usually work on level ground and on the same site, earth-moving vehicles must be able to travel for significant stretches on roads, including unpaved roads, without stations for recharging or replacing the batteries.

SUMMARY OF THE INVENTION

The aim of the present invention is to provide an electric earth-moving vehicle, particularly for poorly ventilated locations, which can travel over significant distances on roads, can operate without emitting toxic gases, can be fitted with equipment of any kind which can be actuated hydraulically and has a significant operating range.

Within the scope of this aim, an object of the present invention is to achieve the above aim with a structure which is simple, relatively easy to provide in practice, safe in use, effective in operation and relatively modest in cost.

This aim, this object and others which will become apparent hereinafter are achieved by an electric earth-moving vehicle particularly for poorly ventilated locations, according to the present invention, characterized in that it comprises an electric motor drive for driving wheels of the vehicle, a hydraulic unit which is actuated by a further electric motor drive for the equipment installed on the vehicle, at least two sets of batteries for said motor drives, a control unit for connecting said motor drives to said sets of batteries which is adapted to connect the motor drives individually or simultaneously to one set of batteries or the other or to both, and a supporting chassis which has, in a median and downward region, a tunnel for inserting one of said sets of batteries.

BRIEF DESCRIPTION OF THE DRAWINGS

Further characteristics and advantages of the present invention will become apparent from the following detailed description of a preferred but not exclusive embodiment of an electric earth-moving vehicle particularly for poorly ventilated locations, according to the invention, illustrated only by way of non-limitative example in the accompanying drawings, wherein.

DESCRIPTION OF THE PREFERRED EMBODIMENTS

Figure 1:
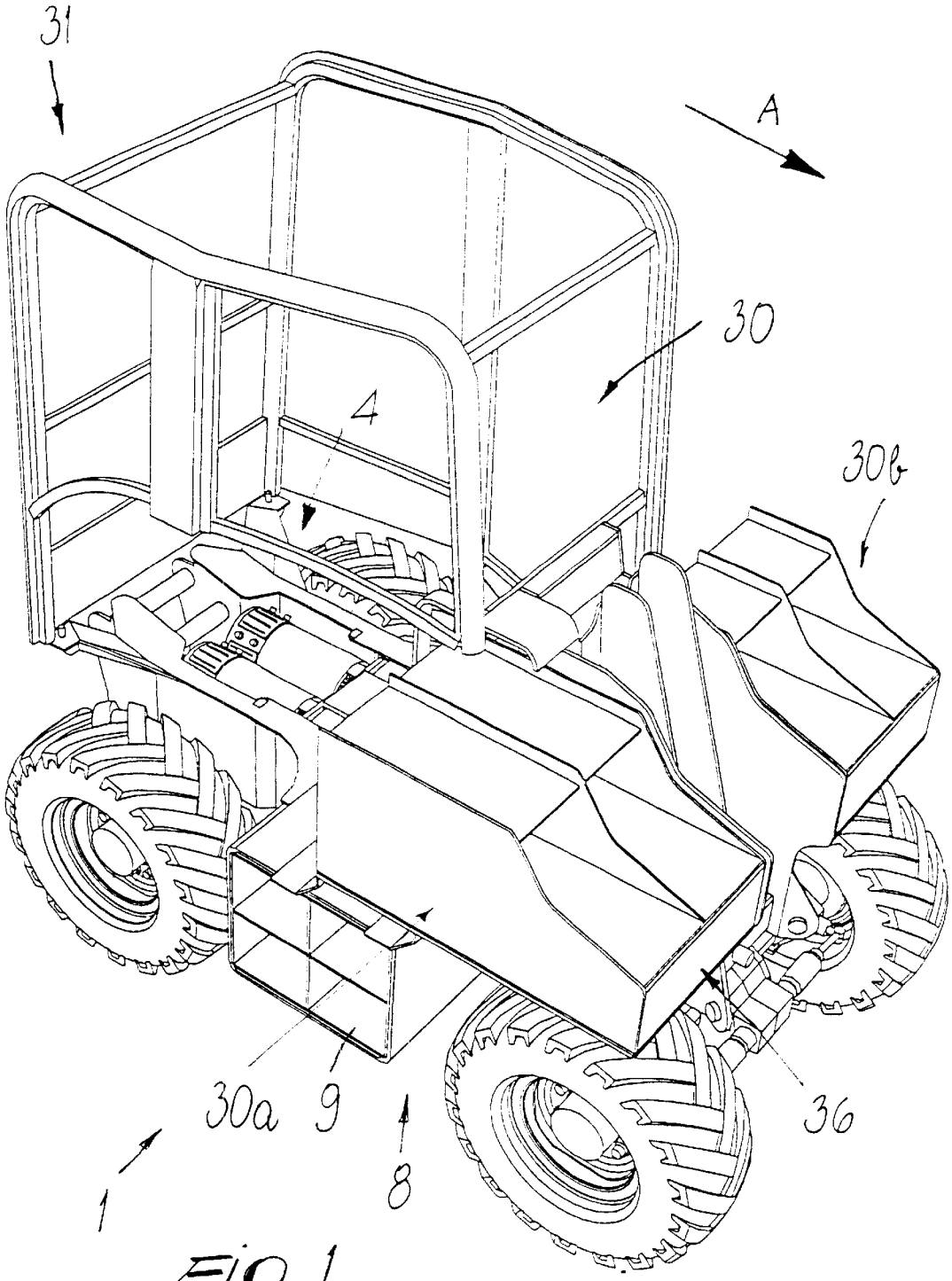
FIG. 1 is a schematic perspective view of an electric earth-moving vehicle, particularly for poorly ventilated locations, according to the present invention.
Figure 2:
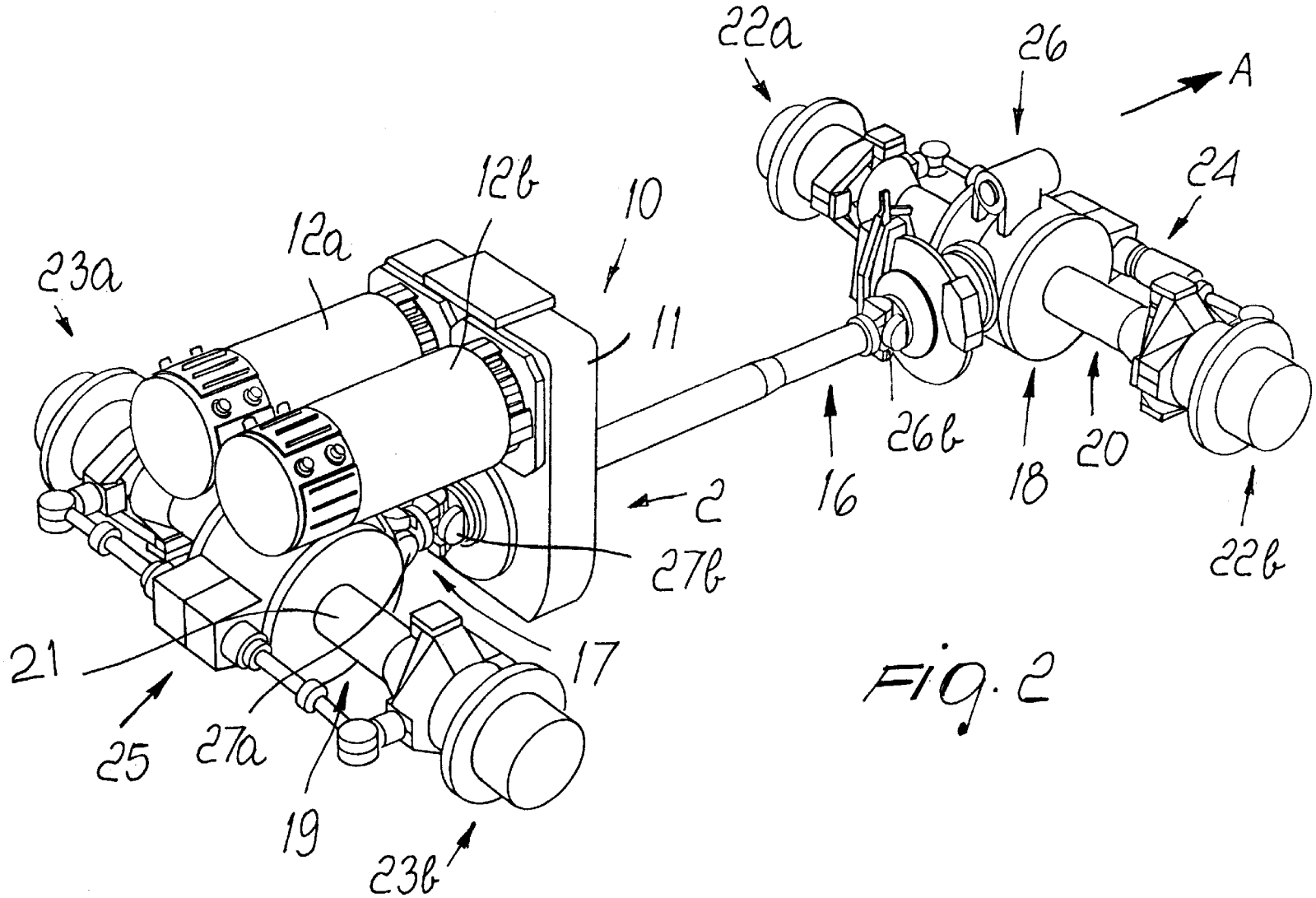
FIG. 2 is a rear perspective view of the travel components of the vehicle.
Figure 3:
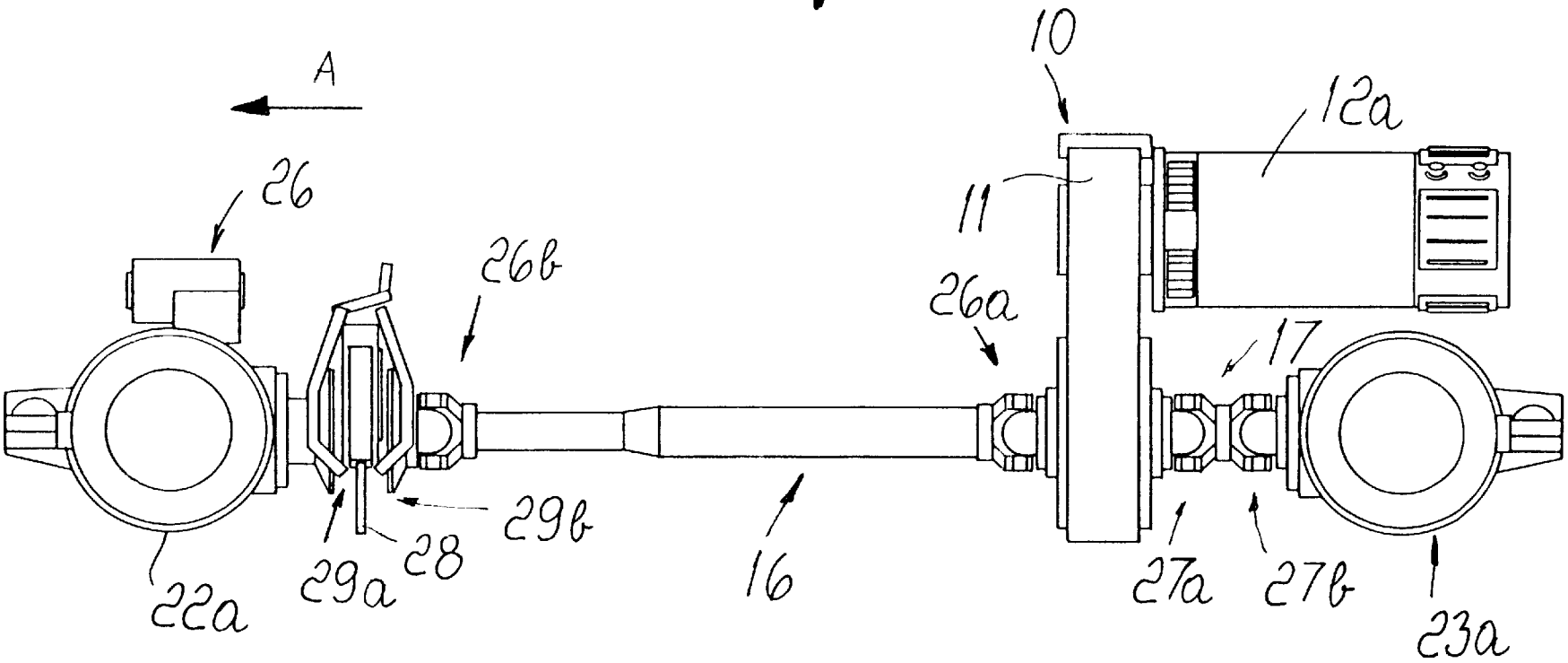
FIG. 3 is a side view of the travel components of the vehicle.
Figure 4:
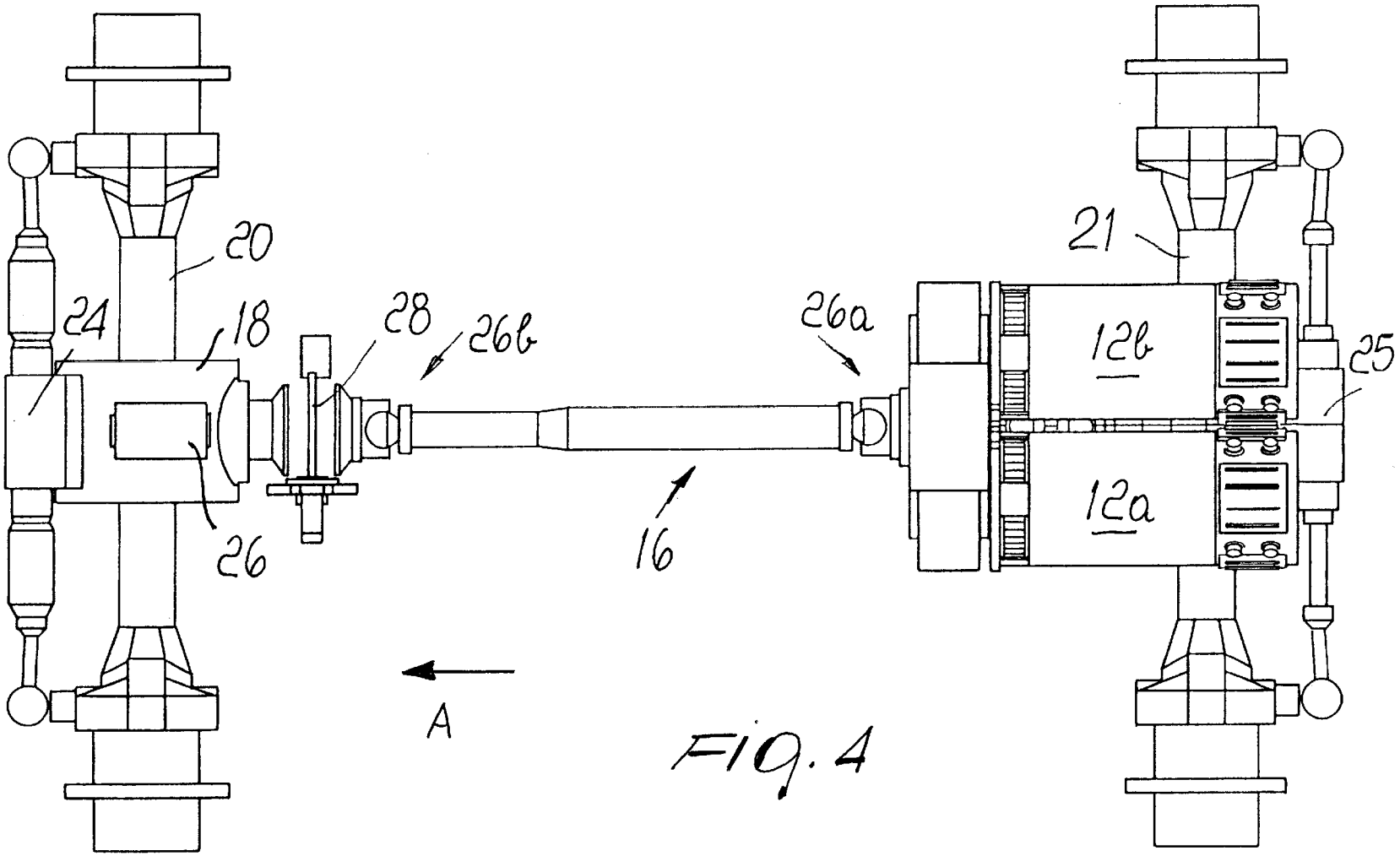
FIG. 4 is a top view of the travel components of the vehicle.
Figures 6A, 6B, 6C:
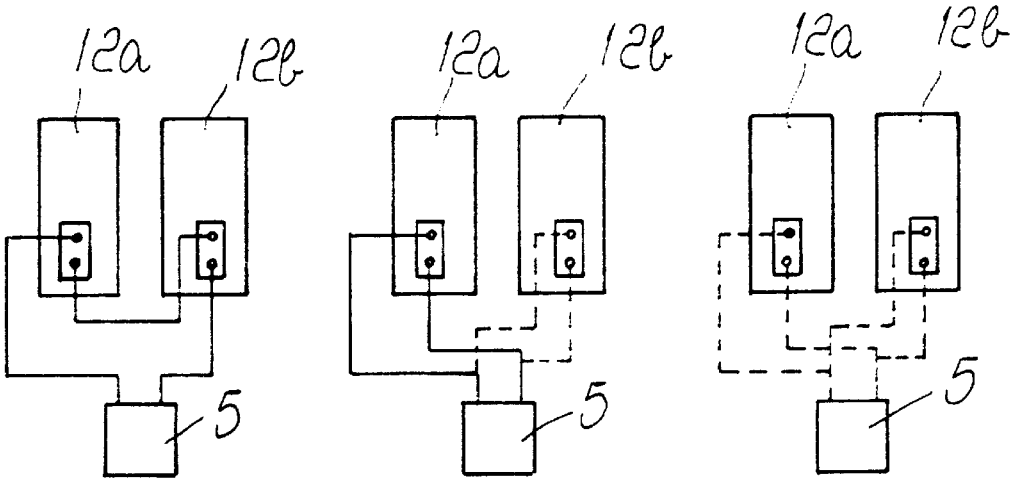
FIGS. 6*a*–6*c* are block diagrams of the electric power supply of the travel motor drive assembly of the vehicle with two electric motors in various planned connection options.
Figure 5:
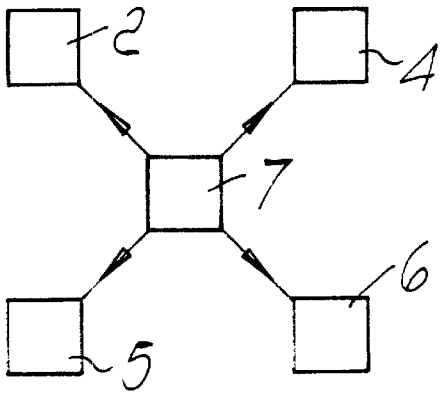
FIG. 5 is a block diagram of the electric power supply of the vehicle.
Figure 7:
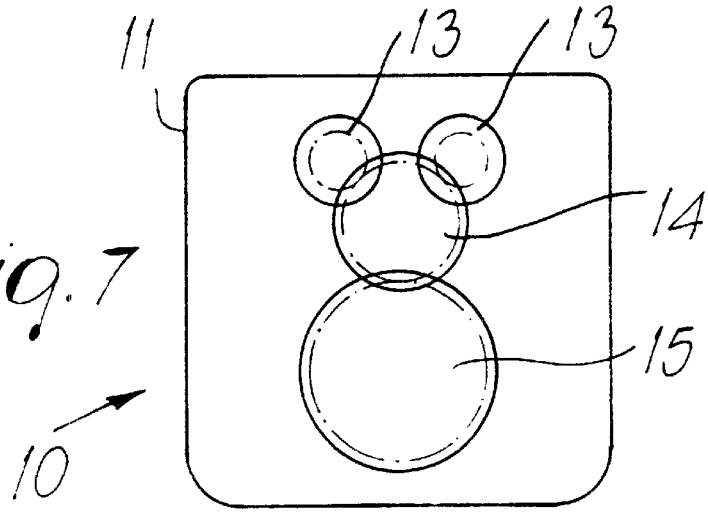
FIG. 7 is a front view of a gear-type distribution and reduction unit of the travel motor drive assembly.
Figure 8:
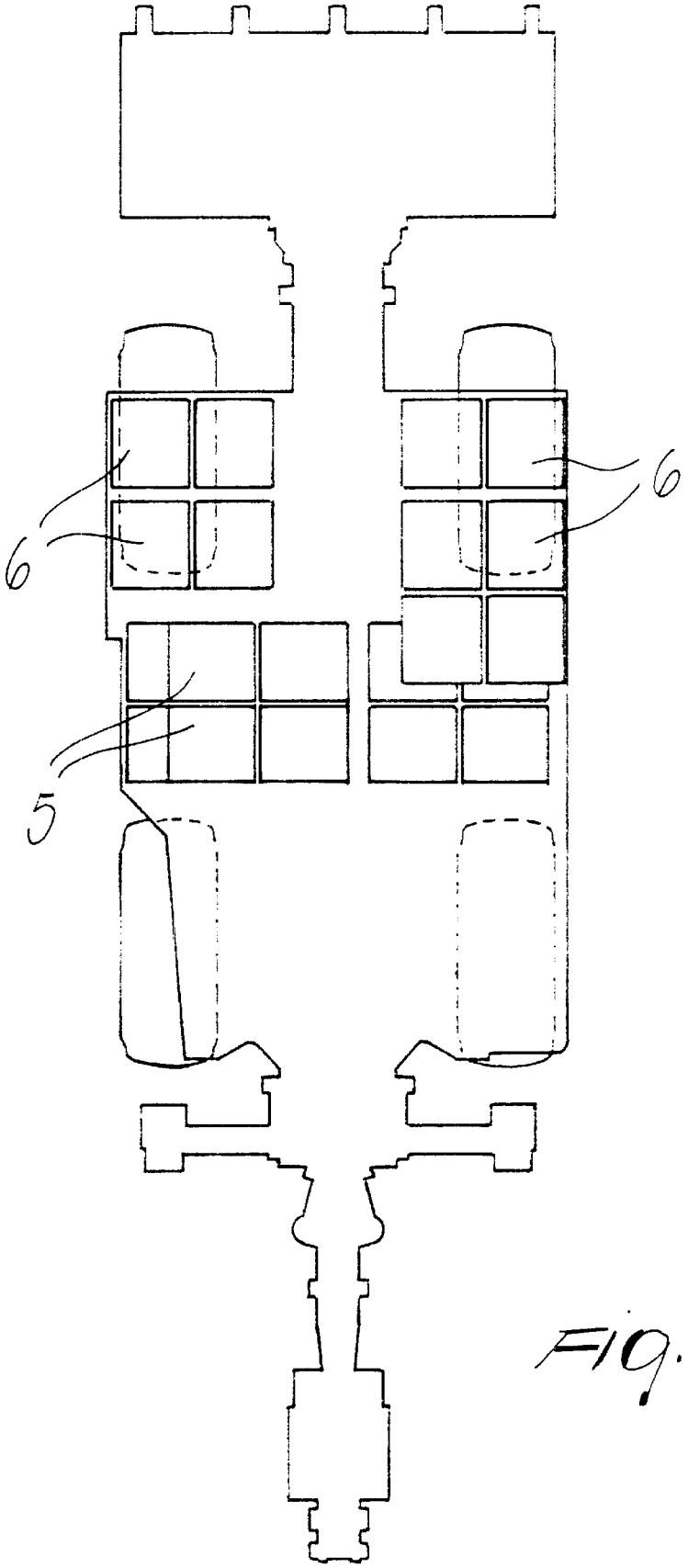
FIG. 8 is a schematic top view which highlights the regions where the power supply batteries are located.
Figure 9:
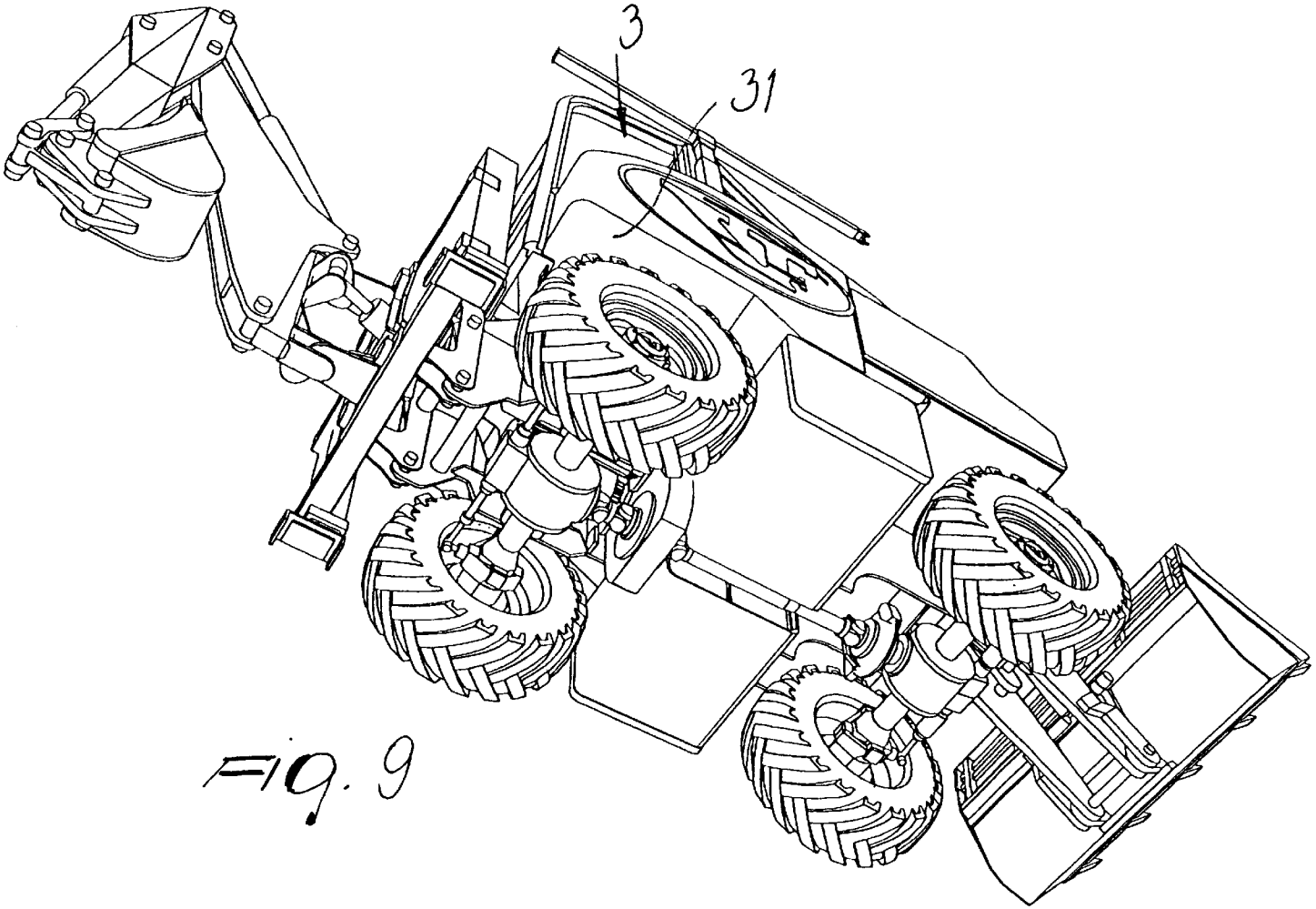
FIG. 9 is a bottom overall perspective view of the vehicle with equipment fitted at the front and at the rear.

With particular reference to the above figures, the reference numeral 1 generally designates an electric earth-moving vehicle, particularly for poorly ventilated locations, according to the invention, whose usual forward travel direction is designated by the arrow A.

The vehicle 1 comprises an electric motor drive 2 for driving wheels of the vehicle and a hydraulic assembly 3 which is actuated by an electric motor drive 4 for the equipment installed on the vehicle; the reference numerals 5 and 6 designate two sets of batteries for the (at least two sets of batteries are provided) motor drives and the reference numeral 7 designates a control unit for connecting the motor drives 2 and 4 to the assemblies 5 and 6, which is capable of connecting the motor drives individually or simultaneously to one set or the other or to both sets of batteries; the reference numeral 8 designates a supporting chassis which runs longitudinally with respect to the vehicle, is formed by welding sturdy contoured metal plates, and has, in a median and downward position, a tunnel 9 for inserting the first one of said sets of batteries.

The motor drive 2 comprises a gear-type distribution and reduction unit 10 which is installed in a housing 11 which is rigidly coupled to the chassis 8 to the rear of the tunnel 9 and two electric motors 12*a*, 12*b* whose bodies are fixed to the housing 11. The horizontal output shafts of the motors 12*a* and 12*b* are provided with respective toothed sprockets 13 which, optionally by means of an interposed idler gear 14, drive a gear 15 which is keyed onto a front longitudinal distribution shaft 16 and onto a rear longitudinal distribution shaft 17, both of the shafts protruding from the housing.

The shafts 16 and 17 can be either a single rigid shaft whose two ends protrude from the housing or two separate shafts which are mutually connected by a differential of self-locking or manually lockable type for road travel.

Two differentials 18 and 19 are installed at the respective ends of the two shafts 16 and 17, and a front axle 20 and a rear axle 21 protrude respectively from the differentials and are meant for respective pairs of hubs and respective driving wheels 22*a*, 22*b* and 23*a*, 23*b*, at least one of the axles being provided with steering elements: in the particular case shown, both axles have respective conventional steering elements 24 and 25.

The reference numeral 26 generally designates an assembly for the oscillating support of the front axle which is fixed, in a downward region, to the front end of the supporting chassis 8.

The tunnel 9 for accommodating the first set of batteries is transversely open and forms a box-like compartment which can be a single through compartment or can be constituted by two compartment sections which are separated by a duct for the passage of the front distribution shaft.

As shown above, there are two electric motors 12*a*, 12*b* for the driving wheels which are connected by means of the distribution and reduction unit to the distribution shafts 16 and 17 and can be connected, by means of the control unit 7, to one of the sets of batteries 5 or 6 in series or individually or in parallel, in order to be able to provide incrementally higher speeds: advantageously, the shafts 16 and 17 have, at their ends, respective universal joints 26*a*, 26*b*, 27*a* and 27*b*.

The battery sets 5, 6 are of a type known as gel-cell or absorbed-acid batteries, and are adapted to operate even with high inclinations and under intense mechanical stress.

A disk 28 is fixed at right angles to one of the distribution shafts, particularly to the front one, and is adapted to be braked by two braking shoes 29*a* and 29*b*.

The supporting chassis has two compartments 30*a*, 30*b* which are substantially located above the front wheels for the second one of the two sets of batteries.

On top of the supporting chassis, substantially in the rear central region of the vehicle, there is a driver's station 30 to the side of which there is a platform 31 for supporting the hydraulic assembly 3 and the associated electric motor drive 4. The driver's station 30 can be accommodated inside a protective cabin 31 provided with a supporting structure composed of shaped tubular elements.

Advantageously, the vehicle is provided with a platform 36 (see FIG. 1) on which an electricity-generating unit can be carried in order to recharge the battery sets 5 and 6: the unit can be deposited in an area where it can operate without causing pollution problems and can be connected, even by means of a long cable, to the vehicle in order to recharge the batteries during operation.

The electric earth-moving vehicle, particularly for poorly ventilated locations, according to the invention is capable of covering even long stretches on roads, since the travel motors can be supplied by any one of the battery sets so as to increase speed or range according to requirements; moreover, it can operate without emitting toxic gases and can be fitted with equipment of any kind which can be actuated hydraulically.

It has thus been shown that the invention achieves the intended aim and object.

The invention thus conceived is susceptible of numerous modifications and variations, all of which are within the scope of the inventive concept.

All the details may furthermore be replaced with other technically equivalent ones.

In practice, the materials used, as well as the shapes and the dimensions, may be any according to requirements without thereby abandoning the scope of the protection of the appended claims.

The disclosures in Italian Patent Application No. BO99A000076 from which this application claims priority are incorporated herein by reference.

What is claimed is:

1. An electric earth-moving four-wheel drive vehicle, for poorly ventilated locations, comprising an electric motor drive for driving wheels of the vehicle, a hydraulic unit which is actuated by a further electric motor drive for equipment installed on the vehicle, at least two sets of batteries for said motor drives, a control unit for connecting said motor drives to said two sets of batteries which is adapted to connect the motor drives individually or simultaneously to one set of batteries or the other or to both, and a supporting chassis which has, in a median and downward region, a tunnel for inserting one of said two sets of batteries, said supporting chassis further having two compartments for a second one of said two sets of batteries, said two compartments being spatially separated in a direction substantially parallel to said tunnel, and each of the two compartments being arranged substantially above a respective front wheel of the vehicle.

2. The vehicle according to claim 1, wherein said motor drive for the driving wheels comprises a gear-type distribution and reduction unit which is installed in a housing which is rigidly coupled to said chassis to the rear of said tunnel, two electric motors whose body is fixed to said housing, a front longitudinal distribution shaft and a rear longitudinal distribution shaft which protrude from said housing, two differentials fitted at the ends of said distribution shafts, from which a front axle and a rear axle for respective pairs of driving wheels respectively protrude, at least one of said axles being provided with steering elements, an assembly for an oscillating support of said front axle which is fixed in a downward region at a front end of said supporting chassis.

3. The vehicle according to claim 2, wherein said electric motors for the driving wheels are connected to said distribution shafts by means of said distribution and reduction unit and can be connected by means of said control unit to one of the two sets of batteries in series or individually or in parallel, to provide incrementally higher speeds.

4. The vehicle according to claim 2, wherein said front and rear longitudinal distribution shafts are a single rigid shaft whose two ends protrude from said housing.

5. The vehicle according to claim 2, wherein said front and rear longitudinal distribution shafts are separate and are mutually connected by a differential of self-locking or manually-lockable type for road travel.

6. The vehicle according to claim 2, wherein a disk is fixed at right angles to one of said front and rear longitudinal distribution shafts and is adapted to be braked by two braking shoes.

7. The vehicle according to claim 1, wherein said tunnel is transversely open.

8. The vehicle according to claim 1, wherein said two sets of batteries are of a type known as gel-cell and are adapted to operate even with high inclinations and under intense mechanical stress.

9. The vehicle according to claim 1, wherein said two sets of batteries are of a type known as absorbed-acid batteries and are adapted to operate even with high inclinations and under intense mechanical stress.

10. The vehicle according to claim 1, wherein said supporting chassis has a driver's station to a side of which there is a supporting platform for said hydraulic unit and for said electric motor drive, which lie substantially on a rear centerline of the vehicle.

* * * * *